US007225517B2

(12) United States Patent
Mitchell

(10) Patent No.: US 7,225,517 B2
(45) Date of Patent: Jun. 5, 2007

(54) HOLDING DEVICE

(75) Inventor: David Mitchell, Carina Heights (AU)

(73) Assignee: Private Brand Tools (Australia) Pty Ltd, Queensland (AU)

( * ) Notice: Subject to any disclaimer, the term of this patent is extended or adjusted under 35 U.S.C. 154(b) by 0 days.

(21) Appl. No.: 10/949,195

(22) Filed: Sep. 27, 2004

(65) Prior Publication Data

US 2006/0064862 A1 Mar. 30, 2006

(51) Int. Cl.
*B25B 27/14* (2006.01)

(52) U.S. Cl. ..... 29/281.5; 29/281.6

(58) Field of Classification Search ..... 29/281.5, 29/281.6, 281.1, 888.011, 402.03, 402.08, 29/426.1, 464, 239; 269/253, 203, 258, 262, 269/261, 268, 270, 904, 35, 37, 82; 188/2 R, 188/4 R, 36, 74

See application file for complete search history.

(56) References Cited

U.S. PATENT DOCUMENTS 3,960,048 A * 6/1976 Wagner ..... 411/11
6,058,585 A * 5/2000 Soleymani ..... 29/281.6
6,332,256 B1 12/2001 Dawson
6,698,075 B1 * 3/2004 Wu ..... 29/281.5
2004/0042848 A1 3/2004 Dawson

FOREIGN PATENT DOCUMENTS

GB 2 340 539 2/2000

* cited by examiner

*Primary Examiner*—Robert C. Watson
(74) *Attorney, Agent, or Firm*—Nixon & Vanderhye P.C.

(57) ABSTRACT

There is disclosed a holding device for holding two rotary members relative to one another. The device has two holding members and a connecting member to which the holding members may be clamped by respective clamps. One of the holding members may be selectively positioned along the connecting member and clamped thereto at selected distances from the other holding member.

15 Claims, 7 Drawing Sheets

20
21
22
23
44
46
56
26
60
61
63
64
65
66
67

20
22
23
24
44
46
49
49
49
50
50
56
70
70

21
42
46
44
41
40
28
48
27
23
25
33
32
26
31
70

70

70
25
24
23
70
70

44
80
81

21,22
48
50
50
50
49
49
49
44
45
46

HOLDING DEVICE

BACKGROUND OF THE INVENTION

This invention relates to a holding device for holding one cam shaft of an engine relative to another cam shaft of an engine to prevent rotation of the cam shafts.

The holding device of the invention has been devised for restraining cam shafts of a double overhead cam shaft internal combustion engine against rotation. Where an internal combustion engine has four cam shafts, two holding devices according to the invention may be employed to prevent the cam shafts of each pair of cam shafts from rotating relative to the other cam shaft of that pair.

In internal combustion engines a toothed timing belt is trained around toothed pulleys or sprockets mounted to ends of the cam shafts. These belts require periodic replacement and to ensure that the timing relationship between the cam shafts and crank shaft of the engine is not lost, the cam shafts may need to be held against rotation relative to one another while the belt is removed and a new timing belt is fitted.

Tools for effecting such immobilization of cam shafts are available. Often such tools are specifically designed for a particular type of engine and are not usable for other engines. This requires a selection of tools to be stocked in order to enable workshops to perform replacement of timing belts for a variety of different engines types.

U.S. Pat. No. 6,332,256 discloses a holding device intended to be adjustable so that it may suit engines of a variety of types. The holding device of U.S. Pat. No. 6,332,256 is particularly complex in its construction and has a plurality of holding members arranged in pairs with at least three of the holding members being adjustable relative to one another and in one embodiment four clamps are present in order to allow the holding members to be locked relative to one another in a desired orientation.

The arrangement of U.S. Pat. No. 6,332,256, whilst being adjustable, is of a particularly complex construction and relatively difficult to operate.

SUMMARY OF THE INVENTION

It is an objection of the invention to provide a holding device which at least minimises the difficulties mentioned above.

According to one aspect, the invention provides a holding device for holding two rotary elements against rotation relative to one another and having a connecting member, a first unitary holding member with spaced projections for engagement with one of the rotary elements at spaced locations on the one rotary element, a first clamp for clamping the first holding member relative to the connecting member, a second unitary holding member with spaced projections for engagement with the other of the rotary elements at spaced locations on the other rotary element, and a second clamp for clamping the second holding member relative to the connecting member, the holding members being clampable relative to the connecting member at selected distances from one another.

Preferably, the second holding member is moveable along the connecting member and clampable by the second clamp relative to the connecting member at selected locations along the connecting member.

The connecting member may consist of an elongated rail relative to which the holding members are clamped by the respective clamps. The elongated connecting rail may comprise an elongated slotted rail with the second clamp being receivable by the slot in the slotted rail to allow the second holding member to be clamped relative to the rail at selected positions along the length of the slot.

The connecting member may have one continuous slot formed along its length and each of the holding members may be clamped to the connecting member by a clamp which extends through the slot. In an alternative arrangement, the connecting member has an aperture extending through it for receiving one of the clamps and relative to which the holding member may be clamped to the connecting member. A slot may be present relative to which the other clamp may clamp the other holding member relative to the connecting member.

As previously mentioned, the holding device for the invention includes two clamps for clamping the holding members relative to the connecting member. Each clamp may consist of a clamping fastener adapted to extend through the connecting member. Preferably, each clamping fastener consists of a clamping screw having a head at one end and a threaded shank extending from the head adapted to engage with the holding member whereby rotation of the head may clamp the holding member relative to the connecting member.

Each holding member may comprise a holding shoe having spaced projections for engagement with a respective rotary element. Preferably, the holding shoe has a body and two spaced flanges from which the projections may extend. Each of the projections is adapted to be received within a space between adjacent teeth or cogs on a rotary element such as a timing gear located on the end of an engine cam shaft.

In a particular preferred form, each projection has a shoulder or step part way along its height such that a free end of its projection is narrower in transverse cross-section than a base of each projection. By having projections of this particular shape, the device of the invention is more readily suited to use with a variety of different rotary elements. It should be appreciated however that it is not essential to the invention that the projections have this stepped profile.

It is preferred that a washer be positioned between each of the holding members and the connecting member such that the washer is clamped between the connecting member and the holding member when the holding member is clamped to the connecting member. It is preferable that the holding member be clamped to the connecting member to prevent undesired relative rotation of the holding member with respect to the connecting member. To this end, one or both of the facing surfaces of the holding member and the connecting member may be provided with a friction enhancing surface. In one particular embodiment both facing surfaces are provided with friction enhancing raised dimples.

BRIEF DESCRIPTION OF THE INVENTION

The invention will now be described by way of example with reference to the accompany drawings in which.

DETAILED DESCRIPTION OF THE PREFERRED EMBODIMENT

Figure 1:
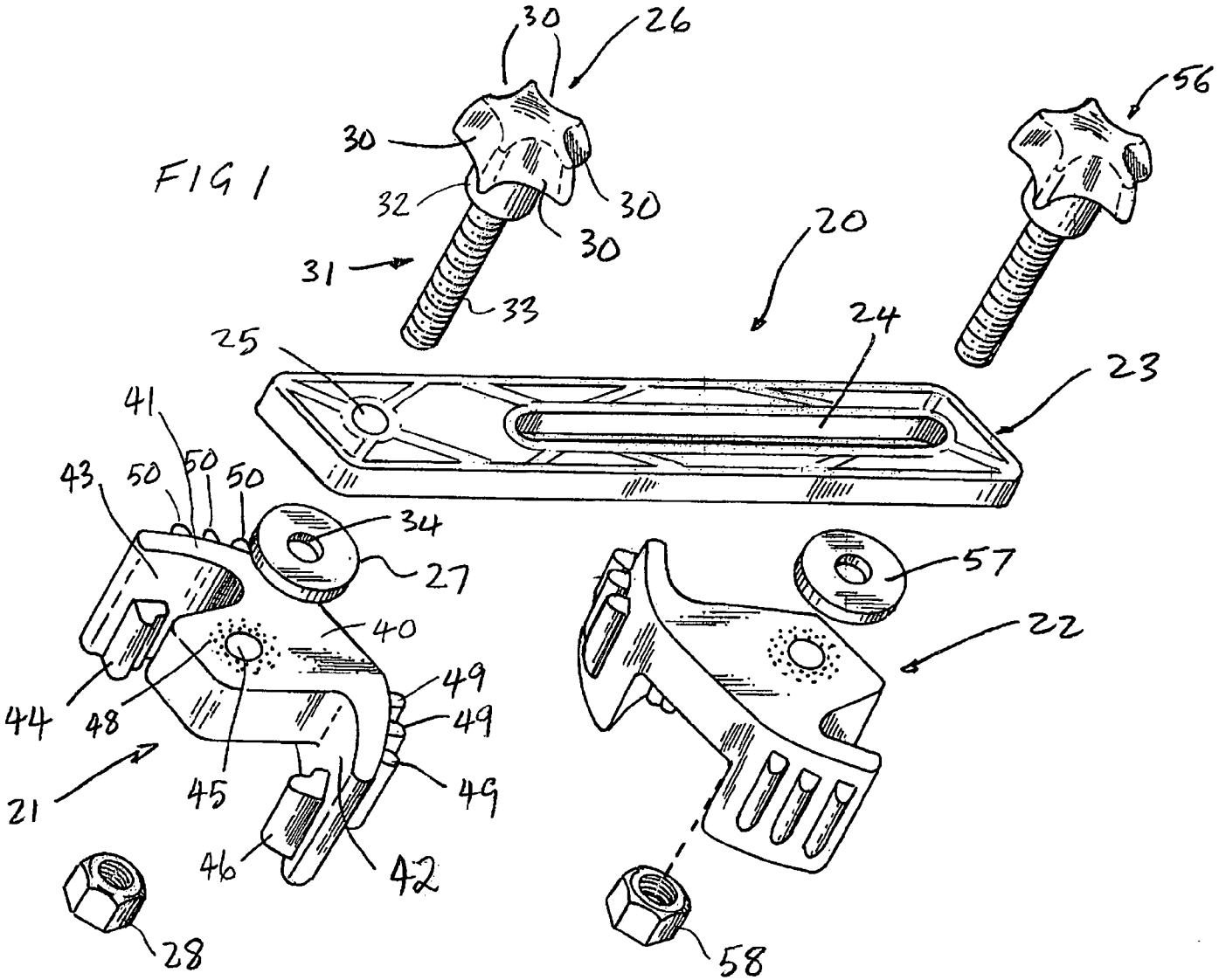
FIG. 1 is an exploded perspective view of a holding device according to a preferred embodiment of the invention.

FIG. 1 of the drawing shows an exploded perspective view of a holding device 20 according to a preferred embodiment of the invention. The holding device has a first holding member 21 and a second holding member 22. The device 20 includes an elongate connecting member 23. The connecting member has a slot 24 extending along a substantial part of its length. An aperture 25 is located adjacent one end of the connecting member 23. The holding member 21 may be clamped and held relative to the connecting member 23 by a clamp consisting of a clamping screw 26, a washer 27 and a nut 28. The clamping screw 26 has a head 29 with a scalloped appearance. This scalloped appearance is achieved by having concave portions 30 formed around the head. This allows the head 29 to be readily grasped and manipulated by the fingers of a user. The shank 31 of the clamping screw 26 an enlarged unthreaded portion 32 from which extends a reduced diameter threaded portion 33. The washer 27 is made of a flexible material and has a central aperture 34 through which the threaded portion 33 of the shank 31 may extend.

The holding member 21 has a central body portion 40 from which extend oppositely directed wings 41 and 42. An inner face 43 of wing 41 is provided with a projection 44 which is directed towards the body portion 40. The body portion 40 has an aperture 45 for receiving the threaded portion 33 of the shank 31.

Wing 42 has a projection 46 extending from face 47 thereof. The projection 46 is also generally directed towards the body portion 40 of the holding member 21. The threaded portion 33 of the shank 31 is received within the nut 28 and the nut 28 is held captive by a recess (not visible in this figure) in the side of the holding member 21 not visible in this view. A plurality of raised friction enhancing dimples 48 extend around the aperture 45.

The holding member 21 has a plurality of raised projections 49 extending outwardly from the wing 42 and raised projections 50 extending outwardly from the wing 41. These projections allow the holding member to be more readily grasped by the user and assist in strengthening the wings 41 and 42.

The holding member 22 is similar in construction and configuration to holding member 21. The holding member 22 may be clamped relative to the connecting member 23 by a clamp consisting of a clamping screw 56, a washer 57 and a nut 58 identical in construction to the clamping screw 26, washer 27 and the nut 28 which form the clamp which functions to clamp the holding member 21 to the connecting member 23.

Figure 2:
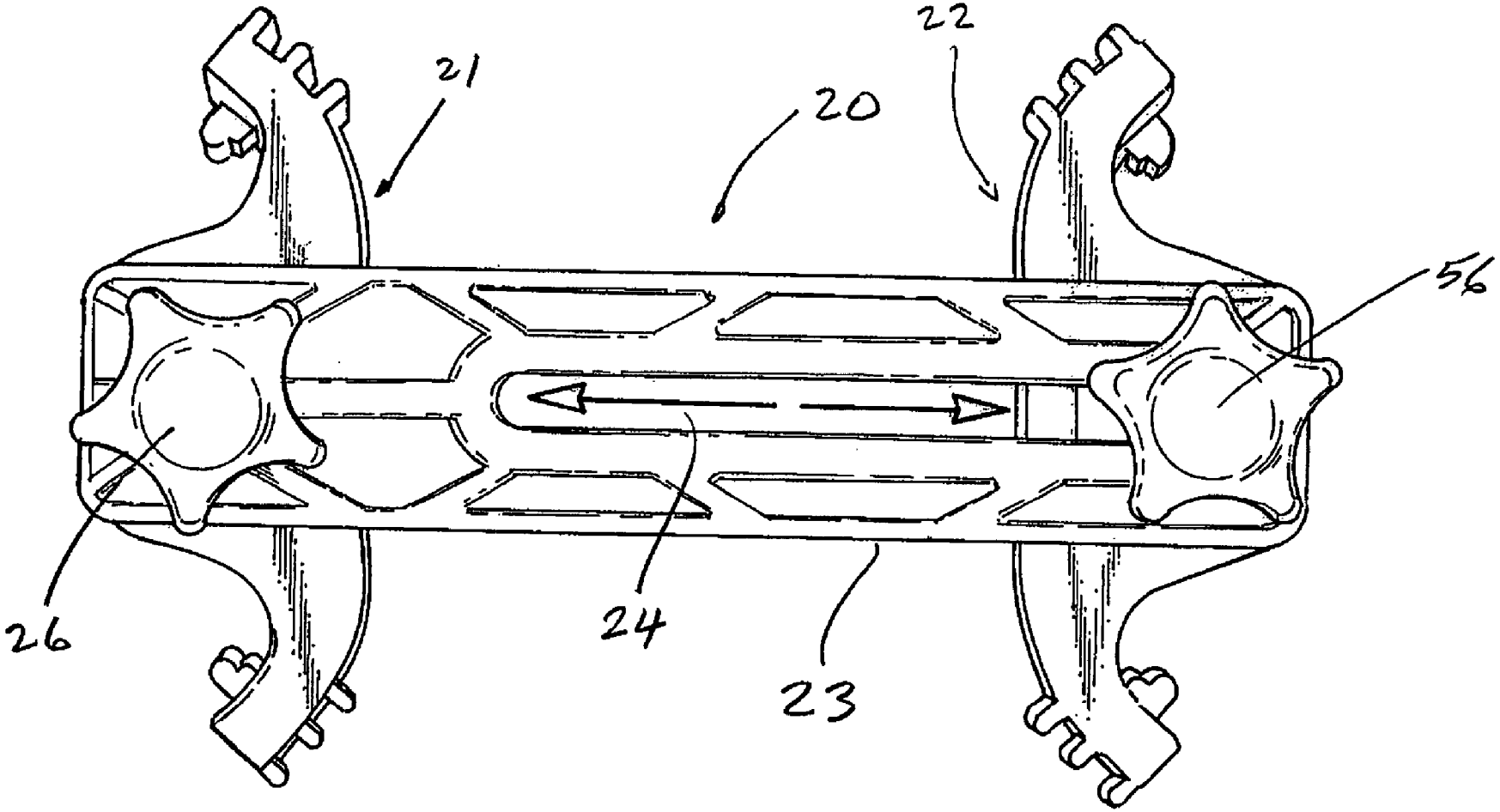
FIG. 2 is an assembled view of the holding device of FIG. 1 with the holding device shown in one configuration.

FIG. 2 of the drawings shows an assembled view of the holding device in a first configuration where the holding member 22 is held clamped to the connecting member 23 at one end of the slot 24 by a clamp including clamping screw 56 as one of the components. The holding member 21 is shown clamped to the connecting member 23 by a clamp which includes clamping screw 26 which extends through the aperture 25 (see FIG. 1) extending through the connecting member 23 and at a location near an end of the connecting member 23 spaced from the location of holding member 22 and the slot 24 in the connecting member 23.

Figure 3:
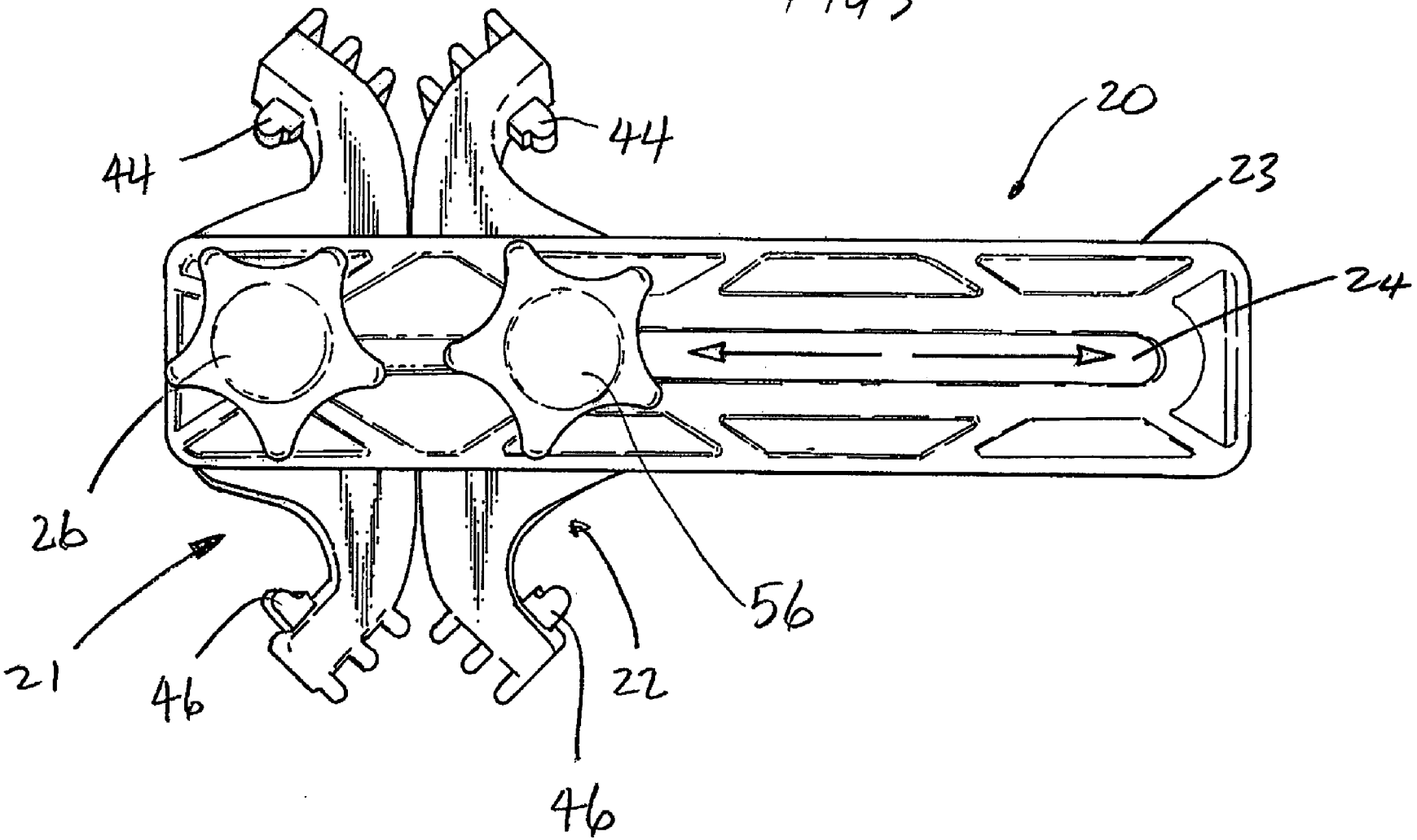
FIG. 3 is an assembled view of the holding device of FIG. 1 with the holding device shown in a configuration different from the configuration of FIG. 2.

FIG. 3 of the drawings shows the holding device 20 of the invention in a configuration different from that of FIG. 2. In this view, the holding members 21 and 22 are clamped to the connecting member in a position closer to one another than what is shown in FIG. 2. Thus, the holding member 22 is adjustable in position along the connecting member relative to the position assumed by holding member 21. In addition to the relative positions of the holding members being adjustable so that they are spaced to a desired degree from one another, it is also possible to clamp the holding members 21 and 22 relative to the connecting member 23 at any desired radial position relative to the connecting member 23. If desired aperture 25 may be omitted and both holding members 21 and 22 may be clamped to connection member 23 by screws 26 and 56 which may both extend through the slot 24. If desired the slot may extend substantially along the full length of member 23.

Figure 4:
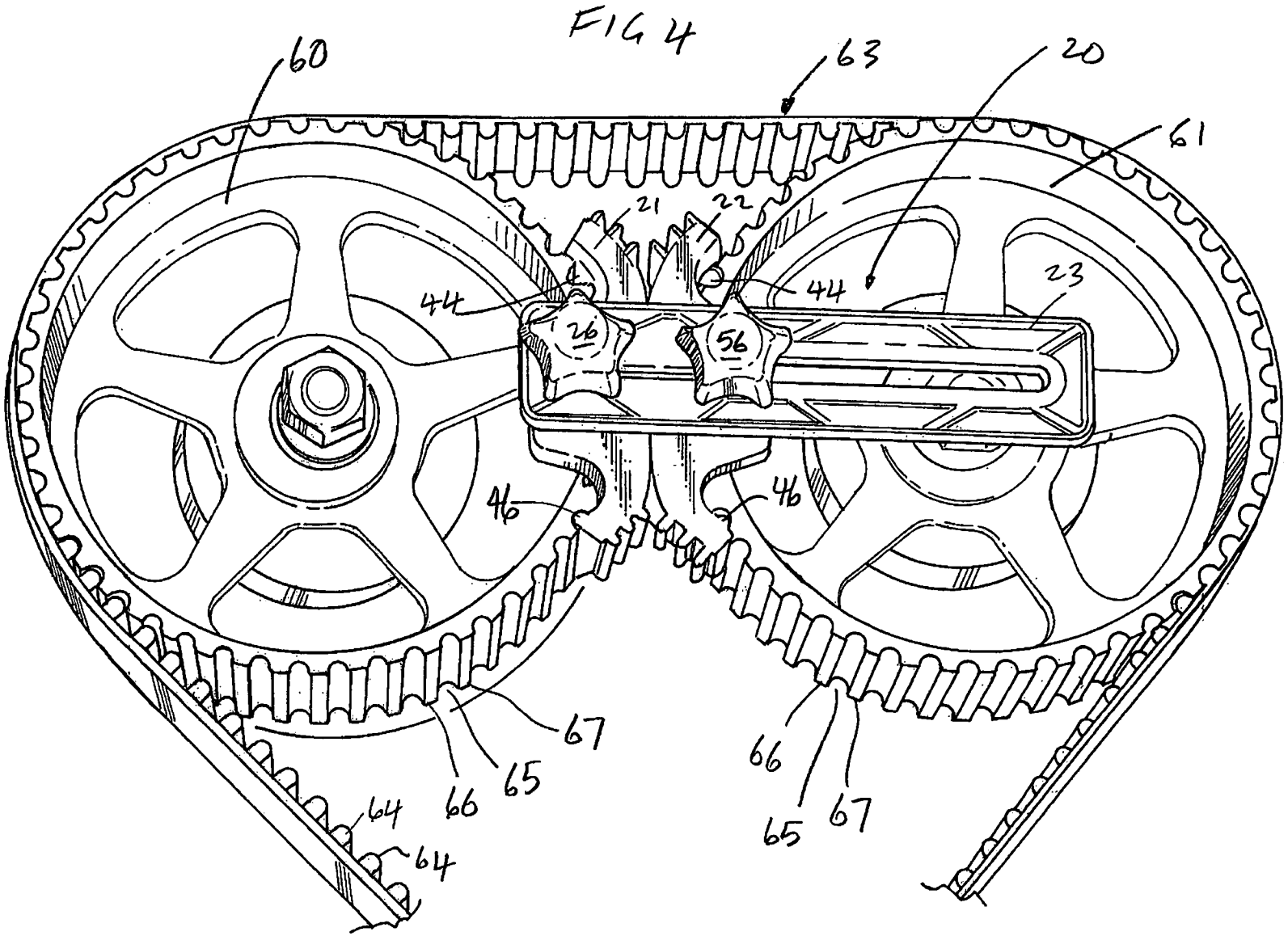
FIG. 4 is a view of the holding device shown in use.

FIG. 4 of the drawings shows a view of the holding device 20 in a position it would assume in use when secured to sprockets 60 and 61. The sprockets 60 and 61 are intended to be representative of timing sprockets mounted to the ends of cam shafts of an engine. A timing belt 63 is trained to extend over the sprockets 60 and 61. The belt 63 would normally have a tensioning device (not shown) associated with it and would extend or be trained over a timing gear (not shown) associated with the engine of which the two cam shafts would form a part. The timing belt 63 has a plurality of teeth 64 adapted to engage within recesses 65 between adjacent teeth 66 and 67 on the sprockets 60 and 61. The holding members 21 and 22 are clamped to the connecting member 23 by the respective clamps of which the clamping screws 26 and 56 form a part. The projections 44 and 46 extending from the holding members 21 and 22 locate relative to recesses between adjacent teeth on the sprockets 60 and 61 and when the holding members 21 and 22 are clamped in the way shown in FIG. 4 the holding device functions to prevent relative rotation of the sprockets 60 and 61.

With the holding device 20 fitted in the manner shown in FIG. 4, the tensioning device mentioned above may be relaxed and this allows the timing belt 63 to be removed from engagement with the sprockets 60 and 61 and replaced. When the timing belt is replaced with a new timing belt the tensioning device may then be used to once again tension that replacement belt and once this is done the holding device of the invention may be removed.

Figure 5:
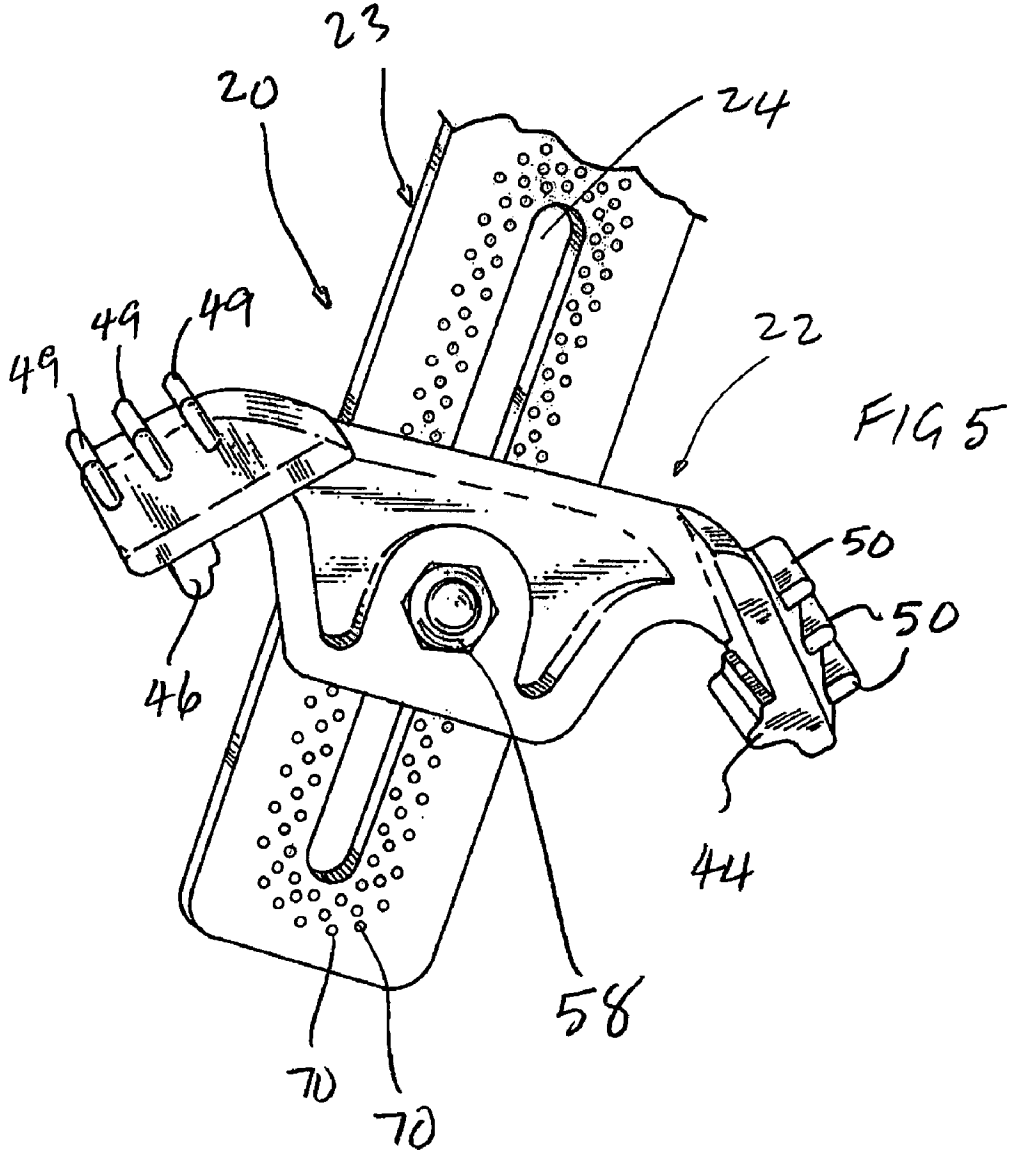
FIG. 5 is a detailed view of a portion of the holding device of the invention.

FIG. 5 of the drawings shows a fragmentary perspective view of part of the holding device 20 of the invention. In this view, the reverse side of the holding member is visible. The nut 58 is received within a recess formed on the reverse side of the holding member 22.

The holding member 21 is configured in a manner identical to the holding member 22 shown in FIG. 5.

As shown in FIG. 5, the underside of the connecting member 23 is provided with a plurality of raised friction enhancing dimples 70. These dimples extend around the slot 24 and also around the underside of the member 23 adjacent aperture 25. These dimples, together with the dimples 48 on the connecting members 21 and 22 assist in preventing movement of the holding members 21 and 22 relative to the connecting member 23 once the holding members 21 and 22 are clamped in position relative to the connecting member 23.

Figure 6:
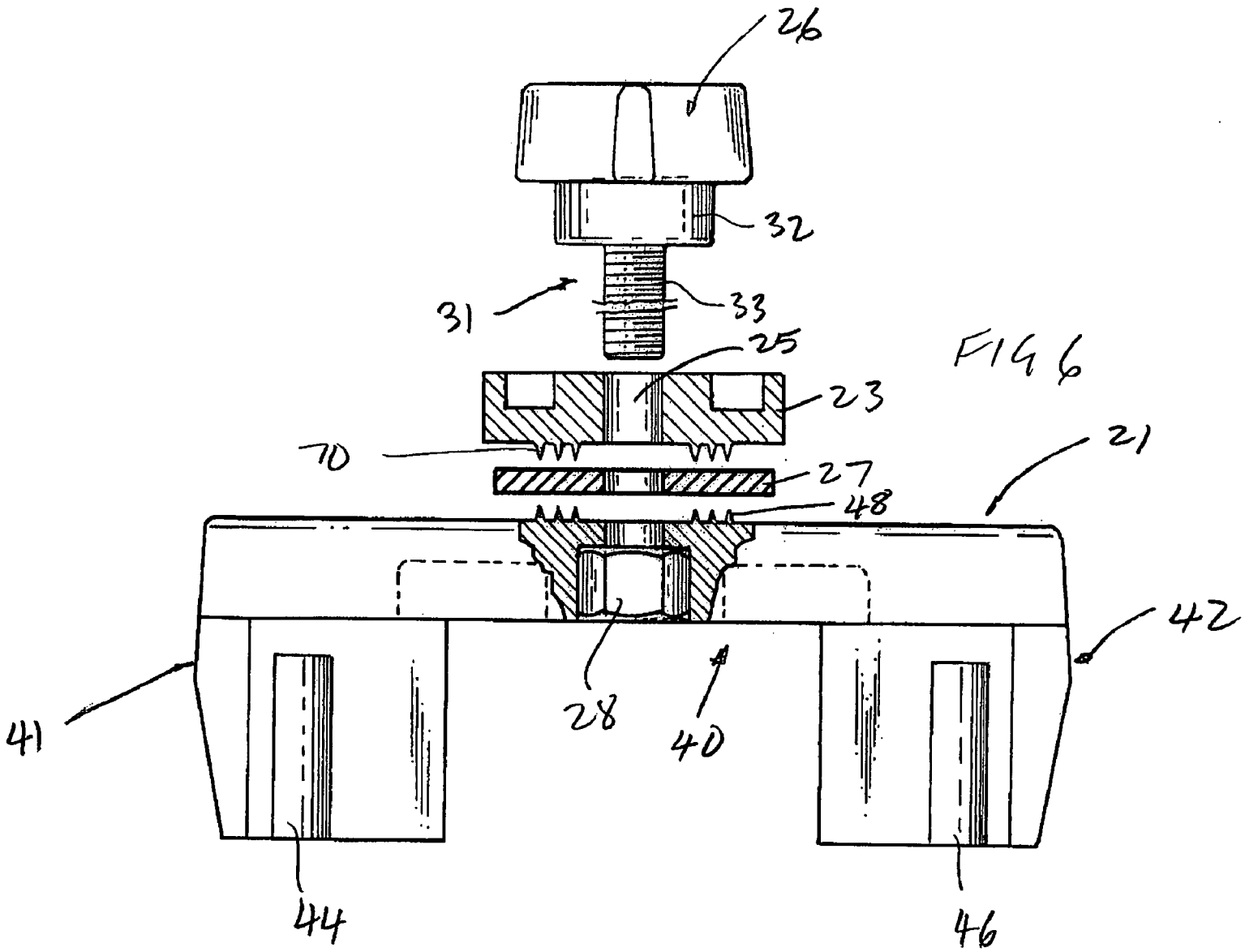
FIG. 6 is an exploded elevational view of a portion of the holding device of the invention.

FIG. 6 of the drawings shows an exploded part sectional view of a portion of the device 20 of the invention. The nut 28 is shown received in a recess provided in the body portion 40 of the holding member 21. When the washer 27 is held captive between the connecting member 23 and the holding member 21, the dimples 70 and 48 may project slightly into the washer 27. This action together with the clamping action by screw 26 assist in securely holding the holding member 21 relative to the connecting member 23 and prevent it from moving relative to the connecting member.

Figures 7, 8, 9, 10:
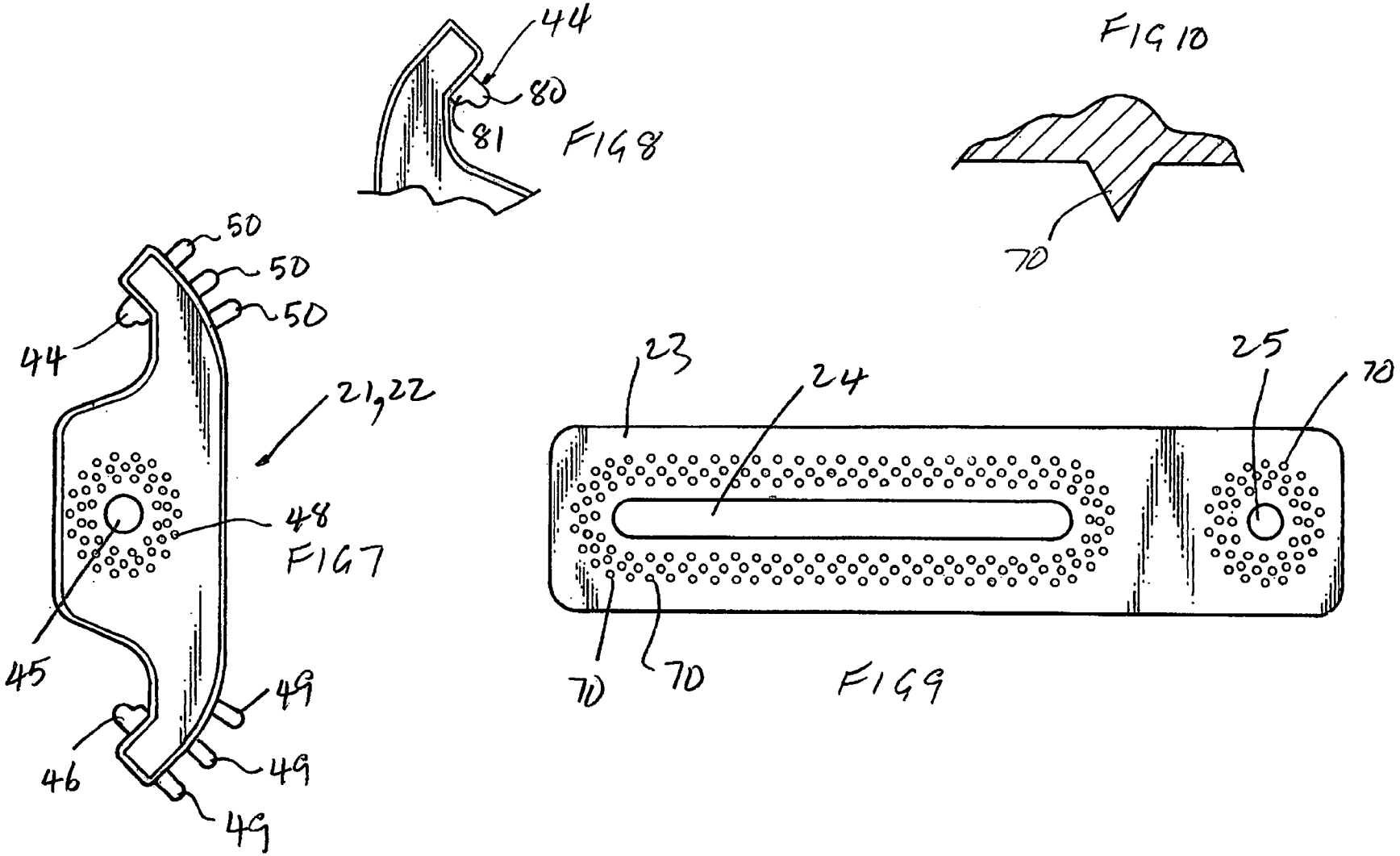
FIG. 7 is a plan view of a holding member.
FIG. 8 is a detailed fragmentary view of a holding member.
FIG. 9 is a plan view of a connecting member.
FIG. 10 is a fragmentary sectional view through a friction enhancing raised dimple.

FIG. 7 of the drawings shows a plan view of one of the holding members 21, 22. As shown in this figure and in the fragmentary view of FIG. 8, the projection 44 has a stepped profile with a reduced width outer end 80 and a wider inner portion 81. Projection 46 is similarly configured. By having the projections shaped in this way they may more readily locate relative to recesses 65 between adjacent teeth on sprockets of a variety of different sizes.

As shown in FIG. 9, the raised friction enhancing dimples 70 extend around the slot 24 in the connecting member 23 and also extend around the aperture 25. In this embodiment of the device, the dimples 70 may have a shape like that shown in the enlarged fragmentary sectional view of FIG. 10. The dimples 48 which extend around the aperture 45 in the holding member shown in FIG. 47 may have a configuration the same as that for dimples 70.

The invention claimed is:

1. A holding device for holding a first rotary elements and a second rotary element against rotation relative to one another, said holding device having:

a connecting member;

a first unitary holding member with spaced projections for engagement with the first rotary element at spaced locations on the first rotary element, wherein each said projection has a stepped profile and is engageable in a recess between adjacent teeth on the first rotary element;

a first clamp for clamping the first holding member at selected radial positions relative to the connecting member;

a second unitary holding member with spaced projections for engagement with the second rotary element at spaced locations on the second rotary element, wherein each said projection has a stepped profile and is engageable in a recess between adjacent teeth on the second rotary element; and a second clamp for clamping the second holding member at selected radial positions relative to the connecting member, wherein the holding members are clampable relative to the connecting member at selected distances from one another.

2. The device of claim 1 wherein the second holding member is movable along the connecting member and clampable by the second clamp relative to the connecting member at selected locations located along the connecting member.

3. The device of claim 1 wherein the connecting member has a slot extending along it and at least one of the holding members is clamped relative to the slot in the connecting member.

4. The device of claim 3 wherein the connecting member has an aperture and one of the holding members is clamped relative to the aperture in the connecting member.

5. The device of claim 4 wherein the first holding member is clamped relative to the aperture and the second holding member is clamped relative to the slot.

6. The device of claim 4 including friction enhancing raised dimples around the slot and the aperture in the connecting member.

7. The device of claim 1 wherein the projections have a reduced width outer portion and a wider inner portion.

8. The device of claim 1 wherein the holding members have a body portion with oppositely directed wings.

9. The device of claim 8 wherein the projections are present on the wings and are directed towards the body portion.

10. The device of claim 9 having an aperture extending through the body portion.

11. The device of claim 10 including friction enhancing raised dimples around the aperture.

12. The device of claim 1 wherein the first and the second clamps each include a friction washer and a clamping screw.

13. A holding device for holding a first rotary element and a second rotary element against rotation relative to one another, said holding device having:

an elongated connecting member with an aperture adjacent one end and a slot extending from adjacent the other end and terminating short of the apertures;

a first unitary holding member with spaced projections for engagement with the first rotary elements at spaced locations along the first rotary element, wherein each said projection has a stepped profile and is engageable in a recess between adjacent teeth on the first rotary element;

a first clamp for clamping the first holding member at a desired radial position relative to the aperture in the connecting member;

a second unitary holding member with spaced projections for engagement with the second rotary element at spaced locations along the second rotary element, wherein each said projection has a stepped profile and is engageable in a recess between adjacent teeth on the second rotary; and a second clamp for clamping the second holding member at a desired radial position relative to the connecting member and at a desired location along the length of the slot in the connecting member.

14. The holding device of claim 13 wherein the first and the second clamps each include a clamping screw, a respective nut held captive by the holding members, and a respective friction washer located between connecting member and said holding members.

15. The holding device of claim 13 including friction enhancing raised dimples on a face of the holding members and on a face of the connecting member for engaging the friction washers when the holding members are clamped to the connecting member.

* * * * *